US007454807B1

(12) United States Patent
Mardan et al.

(10) Patent No.: US 7,454,807 B1
(45) Date of Patent: Nov. 25, 2008

(54) MASSAGING FLUID FILLED BED

(76) Inventors: Perdum Mardan, 4660 Albany Dr., A201, San Jose, CA (US) 95129; Mehri Mafi, 4660 Albany Dr., A201, San Jose, CA (US) 95129

( * ) Notice: Subject to any disclaimer, the term of this patent is extended or adjusted under 35 U.S.C. 154(b) by 350 days.

(21) Appl. No.: 11/336,256

(22) Filed: Jan. 20, 2006

Related U.S. Application Data

(60) Provisional application No. 60/659,164, filed on Mar. 8, 2005.

(51) Int. Cl.
*A47C 27/08* (2006.01)
*A47K 3/12* (2006.01)

(52) U.S. Cl. ..... 5/654; 5/655.3; 5/655.5; 5/909; 4/580; 4/583; 4/585; 4/588

(58) Field of Classification Search ..... 5/654, 5/655.3, 655.5, 644, 706, 709–713, 671–674, 5/676, 678, 682–685, 909; 4/580–583, 585, 4/588
See application file for complete search history.

(56) References Cited

U.S. PATENT DOCUMENTS

| | | | | |
|---|---|---|---|---|
| 585,834 | A | 7/1897 | Ruth | |
| 2,264,672 | A | 12/1941 | Levine | |
| 2,504,646 | A * | 4/1950 | Burrow | 4/588 |
| 2,541,029 | A | 2/1951 | Burton | |
| 2,582,439 | A * | 1/1952 | Kavanagh | 297/396 |
| 2,672,628 | A * | 3/1954 | Spanel | 5/655 |
| 2,822,553 | A | 2/1958 | Florentine | |
| 3,058,122 | A * | 10/1962 | McDaniel et al. | 4/547 |
| 3,574,873 | A * | 4/1971 | Weinstein | 5/655.5 |
| 3,748,669 | A * | 7/1973 | Warner | 5/682 |
| 3,892,000 | A | 7/1975 | Morse | |
| 3,909,859 | A | 10/1975 | Harris | |

(Continued)

FOREIGN PATENT DOCUMENTS

GB 2099296 A * 12/1982

(Continued)

OTHER PUBLICATIONS

Specification and drawings of U.S. Appl. No. 10/646,946, filed Aug. 22, 2003, of Pedrum Mardan and Mehri Mafi entitled "Water Bed for a Bathtub" (abandoned), 15 pgs.

(Continued)

*Primary Examiner*—Robert G Santos
(74) *Attorney, Agent, or Firm*—Blakely, Sokoloff, Taylor & Zafman LLP

(57) ABSTRACT

A massaging fluid filled bed. The massaging fluid filled bed comprises a bed having a top surface, a bottom surface, and a compartment disposed between the top surface and the bottom surface. A plurality of grippers is disposed on the bottom surface. A plurality of massaging elements is disposed beneath the top surface. The bed is further divided into a headrest section, a backrest section, a body section, and a footrest section. An insulation layer is affixed to the bottom surface. A filler fluidly is provided to fill the bed with a fluid. The plurality of massaging elements are attached to a base layer provided within the bed in a way that allows some movements for the massaging elements. The top surface of the body and the backrest section comprises a plurality of inverted U-shaped members.

20 Claims, 3 Drawing Sheets

U.S. PATENT DOCUMENTS 3,931,652 A * 1/1976 Navarra ..... 4/588
3,961,380 A 6/1976 Garr
4,008,498 A 2/1977 Thomas
4,037,591 A * 7/1977 Sarno ..... 601/57
4,051,563 A * 10/1977 Clarke, Jr. ..... 4/575.1
4,254,517 A 3/1981 Herman, Jr.
4,411,033 A * 10/1983 Morgan ..... 5/682
4,511,621 A 4/1985 Thomas et al.
4,737,998 A * 4/1988 Johnson, Sr. ..... 5/422
4,744,112 A * 5/1988 Keesling, Jr. ..... 4/585
4,860,805 A 8/1989 Townsend
4,912,789 A * 4/1990 Maxwell ..... 5/680
4,934,013 A 6/1990 Jacoby
4,964,183 A * 10/1990 LaForce, Jr. ..... 5/421
5,020,168 A * 6/1991 Wood ..... 4/573.1
5,050,591 A * 9/1991 Sandrin ..... 601/168
5,077,848 A * 1/1992 McDaniel et al. ..... 5/682
5,086,528 A * 2/1992 Miller ..... 5/665
5,144,703 A 9/1992 Maire
5,173,346 A * 12/1992 Middleton ..... 428/53
5,247,712 A * 9/1993 Williams ..... 4/585
D343,980 S 2/1994 Torchia
D345,278 S 3/1994 Hamilton et al.
5,345,622 A * 9/1994 Plone ..... 4/588
5,421,043 A * 6/1995 McDaniel et al. ..... 5/684
D359,870 S 7/1995 McLaughlin
5,507,048 A * 4/1996 Hauser et al. ..... 5/685
5,548,851 A * 8/1996 Wien et al. ..... 4/506
D383,834 S 9/1997 Frankel
5,829,070 A 11/1998 Taylor
5,839,132 A 11/1998 Rooney
D407,785 S 4/1999 Scheurer
6,044,506 A * 4/2000 Valene ..... 5/654
6,085,367 A 7/2000 Guiste
D443,686 S 6/2001 Gonzalez
6,336,231 B1 1/2002 Smith
6,357,061 B1 * 3/2002 Gonzalez ..... 4/580
6,378,147 B1 * 4/2002 Halleran ..... 4/579
6,453,485 B2 9/2002 Bullock
6,691,337 B1 2/2004 Banks
6,752,773 B2 6/2004 Leung et al.
2001/0034907 A1 11/2001 Bullock
2003/0024042 A1 2/2003 Leung et al.
2003/0131407 A1 7/2003 Gutierrez et al.
2004/0107495 A1 6/2004 Pleym

FOREIGN PATENT DOCUMENTS

GB 2154447 A * 9/1985

OTHER PUBLICATIONS

Office Action mailed Dec. 10, 2004 for U.S. Appl. No. 10/646,946, 11 pgs.
Specification and drawings of U.S. Des. Appl. No. 29/200,584, filed Mar. 2, 2004 of Pedrum Mardan and Mehri Mafi entitled "Water Bed for a Bathtub" (abandoned), 3 pgs.
Office Action mailed Jan. 4, 2006 for U.S. Des. Appl. No. 29/200,584, 9 pgs.

* cited by examiner

MASSAGING FLUID FILLED BED

RELATED APPLICATION

This present application claims priority to U.S. Provisional application 60/659,164 filed on Mar. 8, 2005, entitled "Bed in the bath," which is hereby incorporated by reference in is entirety.

FIELD

The present invention relates to a massaging fluid filled bed.

BACKGROUND

Numerous innovations for bathtub liners have been provided in the prior art that will be described. Even though these innovations may be suitable for the specific individual purposes to which they address, however, they differ from the present invention.

In a first example, U.S. Pat. No. 2,264,672 to Levine teaches an article of manufacture constituting of a tub lining and comprising a plurality of inflatable rubber cushion elements flexibly joined to permit ready folding and serving as a seat in the tub, a flexible side wall lining connected to the cushion elements and having a re-enforcing border, and a plurality of spaced suction cups on the border of the side wall lining for supporting the lining on the walls of the tub.

In a second example, U.S. Pat. No. 3,892,000 to Morse teaches a liner for a bathtub that includes a soft, flexible cushion having a compressible thickness and separated into sections shaped to cover the bottom, back wall, side walls, and back and side rims of the tub. The bottom section has a hollow interior filled with water so the liner will not float when the tub is filled, and the sections covering the back, sides, and rims of the tub have hollow interiors inflated with air. Preferably, the water-filled bottom section has non-skid surfaces on both its inner walls and on its bottom outer wall. The liner provides a soft, comfortable receptacle in which to bathe, and protects the user from impact with the hard surfaces of the tub.

In a third example, U.S. Pat. No. 3,909,859 to Harris teaches a mattress envelope that has water therein for bathing part of a person on the mattress envelope. A backrest envelope having water therein extends from an area of the mattress envelope in the area of the tub portion thereof at an angle therewith. A pair of armrest envelopes has water therein and extends from opposite sides of the mattress envelope substantially perpendicularly thereto and about the backrest envelope.

In a fourth example, U.S. Pat. No. 4,051,563 to Clarke, Jr. teaches a cushioned liner that fits inside a bath tub has a back cushion provided by a flexible water bag conforming to the back of the tube and left and right side cushions provided by flexible bags conforming to the left and right sides of the tub, the bags being connected together end to end and across the bottom of the tub by a bottom portion that conforms to the tub bottom. The insides of the bags are interconnected and all are filled with water through a common filling hose after installing in the tub and before the tub is filled with water for bathing. When the tub is drained, the bags can be drained through one or more drain plugs and opening and the bottom of the liner are provided to permit draining.

In a fifth example, U.S. Pat. No. 5,839,132 to Rooney teaches an improved disposable bathtub liner that includes inflatable sub-compartments which detachably adhere to the interior surface of a bathtub through suction devices on the exterior surface of the liner. The bathtub liner includes opposite sidewalls, endwalls, and at least a partial bottom, and is made of a material which is durable, economical and disposable, while at the same time provides frictional engagement with a person, and which can be detachably sealed to the interior of the interior surface of the bathtub.

In a sixth example, U.S. Pat. No. 6,336,231 B1 to Smith teaches an inflatable liner for use with conventional bathtubs. For use with infants, elderly, physically disabled, or other instances where a cushioned and/or sanitary bathing surface is desired. A battery operated air pump is attached to the inflatable liner via small plastic tubes. The air pump is used to inflate the liner. The present invention also has an air trap valve to prevent over inflation. The inflatable liner is composed of separate air reservoir tubes that conform to the shape of the bathtub, surrounding the entire interior surface area of the bathtub. Once inflated, the actual tub itself provides the present invention with its shape and rigidity. A convenient drainage hole with cover is incorporated into the inflatable liner, which allows the user to drain water out of the invention and bathtub before the present invention is removed from the tub and stored.

It is apparent that numerous innovations for bathtub liners have been provided in the prior art that are adapted to be used. Furthermore, even though these innovations may be suitable for the specific individual purposes to which they address, however, they would not be suitable for the purposes of the present invention as heretofore described.

SUMMARY

One aspect of the present invention pertains to a massaging fluid filled bed that in one application can be used to line a bathtub. In one embodiment, the massaging fluid filled bed comprises a body section, a footrest section, a backrest section, and a headrest section. All of the sections make up an integral bed that can be filled with a liquid or a fluid. The massaging fluid filled bed can also be filled with a liquid (e.g., hot/cold water or hot/cold gel or air) that provides a treatment. A filler fluidly communicates with all sections of the massaging liquid filled bed and to a liquid or fluid supply source, such as a faucet of the bathtub.

In one embodiment of the present invention, a massaging fluid filled bed is provided. The bed comprises a headrest section, a backrest section, body section, and a footrest section all connected to form an integral bed. All sections of the massaging liquid filled bed can be filled with a fluid or liquid such as water, gel, cold water, and/or hot water, air, or the like. In one embodiment, a filler fluidly communicates with the body and the water faucet of the bathtub. Other fluid sources can be connected to the filler to fill the bed with a fluid or a liquid.

Skid protectors are disposed at least on the body section and prevent slipping by a user. Skid protectors can also be disposed along all sections of the bed. Grippers (such as suction cups) are disposed on the bottom surface of the bed and along the headrest section, the backrest section, the body section, and the footrest section. In one embodiment, the grippers can replaceably attach the bed and its respective sections to the bottom of the bathtub. In another embodiment, the lowermost surface (or the bottom surface) of the bed section is substantially flat. The grippers extend from the bottom surface of the bed. The uppermost surface (or the top surface) of the bed is formed into a plurality of inverted U-shaped members disposed side-by-side and extending longitudinally on the lowermost surface, thereof so as to form therewith a plurality of inverted U-shaped tubes having a plurality of through bores extending through adjacent ones, thereof that allow adjacent ones of the plurality of tubes of the body to fluidly communicate with each other and isolate motion by displacing the water therein accordingly.

In one embodiment, the massaging liquid filled bed comprises a headrest section, a backrest section, a body section and a footrest section that are formed as an integral unit. A plurality of grippers are provided at the bottom surface of every section and a plurality of massaging elements are provided along each section of the bed. The bottom surface of the bed is lined with an insulation layer. The top surface is not lined with such insulation layer to allow the effect of the heated or cold liquid to be felt by a user laying on the top surface of the bed. The insulation layer on the bottom surface prevents temperature to transfer through the bottom surface of the bed, for example, heat lost to the bathtub.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWING

Figure 1:
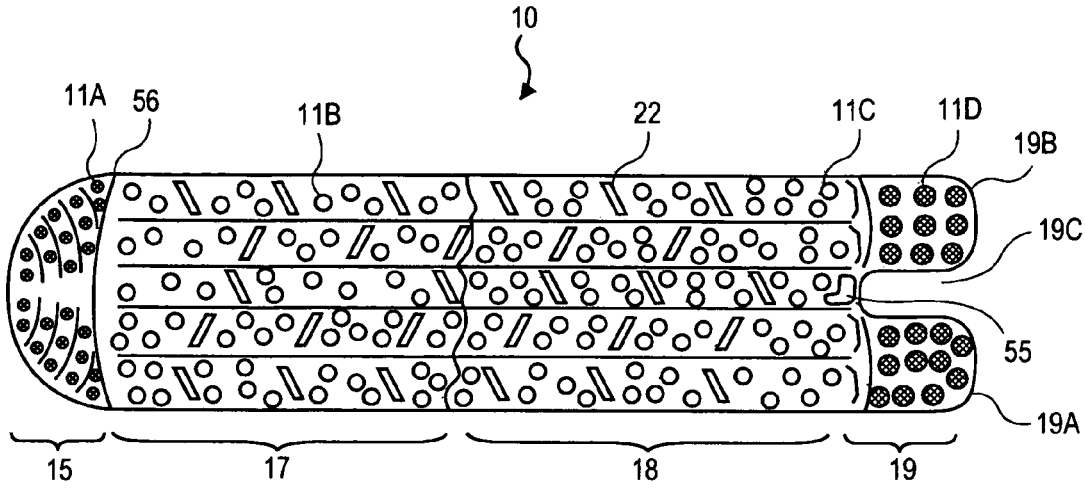
FIG. 1 is an illustration of a massaging fluid filled bed in accordance to embodiments of the present invention laying flat.
Figure 2:
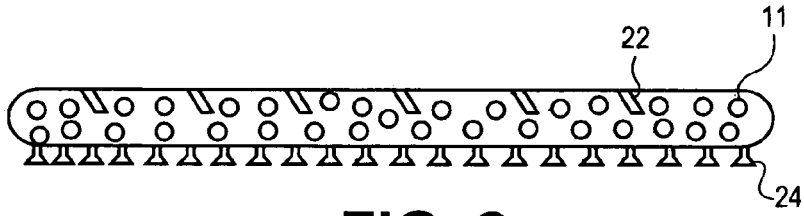
FIG. 2 is a sectional side view of the massaging fluid filled bed.

10 Massaging fluid filled bed
11 Massaging balls/elements
12 Bathtub
13 Base layer of bed
14 Bottom interior surface of bathtub 12
15 Headrest section
16 Water section faucet of bathtub 12
17 Backrest section
18 Body section for resting on bottom of interior surface 14 of bathtub 12
19 Footrest section
20 Filler for fluidly filling the bed
22 Skid protectors for preventing slipping by user (not shown)
24 Grippers for replaceably attaching the bed 10 to a surface
25 Insulation layer
26 Bottom surface of the bed 10
27 Compartment for liquid
28 Uppermost surface of the bed 10
29 Middle support layer
30 Plurality of members of uppermost surface of 28
32 Plurality of tubes
34 Plurality of through bores extending through tubes 32
36 Strips of non-skid roughened material of skid protectors 22
38 Adhesive of skid protectors 22
40 Strips of non-skid roughened material of skid protectors 22
41 Plurality of suction cups of grippers 24
42 Through bore in uppermost surface 28 of body 18
44 Neck around through bore 42
46 Hose of filler 20
48 First end of hose 46 of filler 20
49 Second end of hose 46 of filler 20
50 Female connector of first end 48 of hose 46 of filler 20
52 Female connector on second end 49 of hose 46 of filler 20
54 Cap filler 20
55 Drain flap

DETAILED DESCRIPTION

Referring now to the figures, in which like numerals indicate like parts, and particularly to FIGS. 1-4, which illustrate the massaging fluid filled bed shown generally at 10. In one embodiment, the bed 10 is adapted for used with a bathtub 12. The bathtub 12 has a bottom interior surface 14 and a water faucet 16. It is to be appreciated that the bed 10 can be adapted for use with other surfaces, such as a conventional bed, sofa, floor, mat, or the like.

The massaging fluid filled bed 10 comprises several sections, a body section 18, a backrest section 17, a footrest section 19, and a headrest section 15. The body section 18, backrest section 17, footrest section 19, and headrest section 15 all form an integral unit for the bed 10. The body section 18, backrest section 17, footrest section 19, and headrest section 15 have folds 56 between each two sections to allow for bending or conforming to the surface that supports the bed 10. The massaging fluid filled bed 10 also comprises a filler 20 that communicates fluid to fill all sections of the massaging liquid filled bed. The body section 18 rests on the bottom interior surface 14 of the bathtub 12.

In one embodiment, the filler 20 takes in fluid from a water faucet 16 and allows filling throughout the sections of the bed 10. Preferably, each section of the bed 10 includes a compartment for fluid reservoir. The filler 20 can also take fluid from other sources such as a gas source or other dispenser. In one embodiment, the fluid that fills the bed 10 is a heated gel or fluid or a material that will produce heat. In another embodiment, the fluid that is filled in the head 10 is a cold gel or fluid or a material that produce a cold temperature. The material that fills the head 10 thus can provide a treatment such as heat or cold treatment depending on the applications or needs.

The bed 10 further comprises a skid protector 22 or a plurality of skid protectors 22 and grippers 24. The skid protectors 22 are disposed on the top surface 28 of the bed 10 and the grippers 24 are disposed on the bottom surface 26 of the bed 10. In one embodiment, the skid protectors 22 are disposed along the body section 18 and prevent slipping by a user (not shown). In another embodiment, the skid protectors 22 are disposed on the body section 18 as well as the backrest section 17. In one embodiment, the skid protectors 22 are disposed on all sections of the bed 10. The grippers 24 are disposed along the body section 18, the backrest section 17, the headrest section 15, and the footrest section 19. The grippers 24 replaceably attach the sections of the bed 10 to a surface. For example, in the grippers 24 replaceably attach the sections of the bed 10 to the bottom interior surface 14 of the bathtub 12.

The bed 10 is made of plastic, thin, and generally rectangular shaped or box-line shaped. The bed 10 can be made of a lightweight vinyl material, easy cleaning, waterproof, puncture resistant, tear resistant, compatible to cleaning materials, and able to contain the fluid that fills the various sections of bed 10. In one embodiment, the material for the bed 10 is also resistant to a heated liquid or a cold liquid such that the heated liquid or the cold liquid will not destroy the material of the bed 10. An exemplary material is plastic vinyl. In one embodiment, the bottom surface 26 of the bed 10 can include an insulation layer that prevents heat lost or temperature lost are transfer through the bottom side of the bed 10. For instance, the bottom side of the bed 10 can be lined with a layer of fiber material (an insulation layer 25) such as fiber wool or glass fiber to prevent heat loss through the bottoms side of the bed 10. Other insulation materials can also be used without exceeding the scope of the invention. In this way, the fluid that fills the bed 10 can be heated or cooled and the temperature maintained within the bed 10 to effect a therapeutic treatment (e.g., heat treatment) on the user). Additionally, any heat or cold transfer would be toward the top surface 28 of the bed 10 and thus applied toward the user and not lost through the bottom of the bed 10.

Figure 3A:
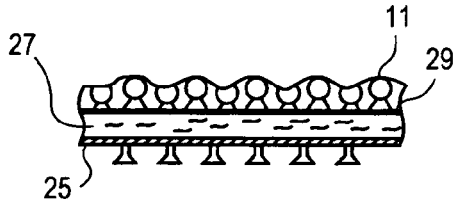
FIGS. 3A-3B are sectional side views of the massaging fluid filled bed.
Figure 3B:
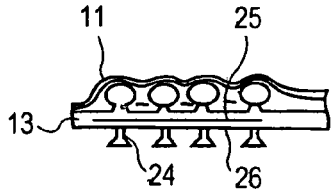
Figure 4:
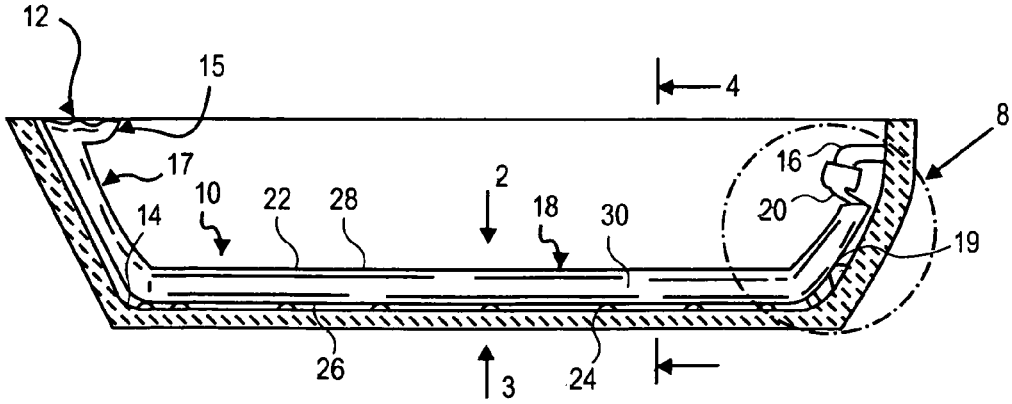
FIG. 4 is a diagrammatic side elevation view of a massaging fluid filled bed placed in a bathtub.

Referring to FIGS. 3A-3B, in one embodiment, the bed 10 comprises a lowermost surface 26, an uppermost surface 28, a compartment 27 to be filled with a fluid, and a middle support layer 29 (FIG. 3A). The middle support layer 29 is disposed below the uppermost surface 28 and above the compartment 27. In one embodiment, a fluid only fills compartment 27 and below the middle support layer 29. In an alternative embodiment, the fluid fills both the compartment 27 and the space between the middle support layer 29 and the uppermost surface 28. The massaging elements or balls 11 are attached to the middle support layer 29. In one embodiment, the massaging elements 11 are moveably attached to the middle support layer 29 in a way that allow the elements 11 to sway back and forth to enhance the massaging effect for the user.

In one embodiment, the massaging elements 11 are attached to a base layer 13 disposed above the lowermost surface 26 (FIG. 3B). The fluid that fills the bed 10 would fill through the space between the base layer and the uppermost surface layer 11. In one embodiment, the massaging elements 11 are moveably attached to the base layer 13 in a way that allow the elements 11 to sway back and forth to enhance the massaging effect for the user.

The massaging elements 11 can have varying degree of hardness and softness depending on the particular section of the bed 10. In one embodiment, the massaging elements 11A for the headrest section 15 and the massaging elements 11B for the backrest section 17 (FIG. 1) can be softer than the massaging elements 11C for the body section 18 and the massaging elements 11D for the backrest section 19. Softer and harder rubber materials, for example, can be used to form the massaging elements 11 of varying degree of softness and hardness.

Figure 5:
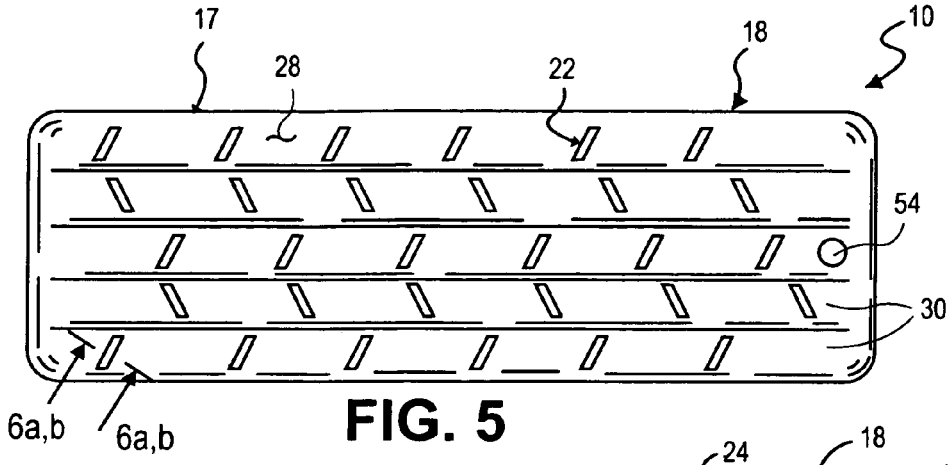
FIG. 5 is a diagrammatic top plan view of a section of the massaging fluid filled bed.
Figure 6:
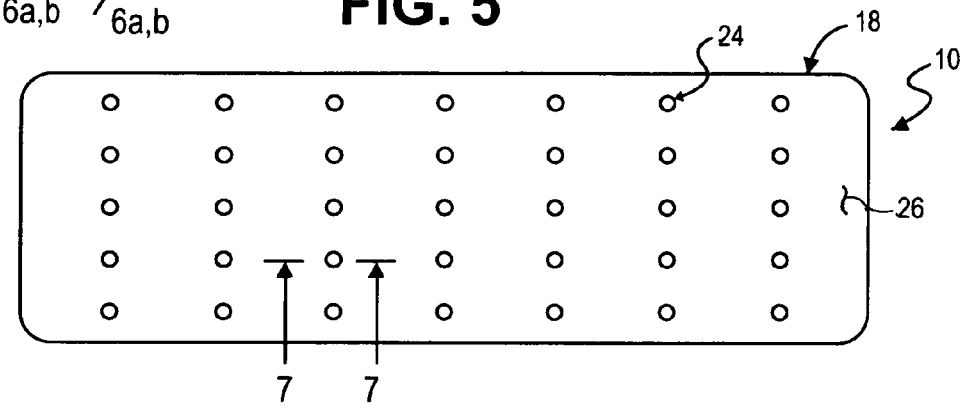
FIG. 6 is a diagrammatic bottom plan view of a section of the massaging fluid filled bed.

FIGS. 5-6 illustrate a section of each of a top surface and a bottom surface of the bed 10. As shown in FIGS. 5 and 6, the bed 10 has a lowermost surface (top surface) 26 and an uppermost surface (bottom surface) 28. The lowermost surface 26 of the bed 10 faces a support structure. In one embodiment, the lowermost surface 26 faces the bottom interior surface 14 of the bathtub 12. The uppermost surface 28 of the bed 10 is opposite to the lowermost surface 26 of the bed 10 and faces away from the support structure, e.g., faces out of the bathtub 12.

Also shown in FIG. 5, the top surface 28 includes the plurality of skid protectors 22. The skid protectors 22 are placed at least over the top surface 28 of the body section 18 and the backrest section 17. Optionally, the skid protectors 22 are also placed over the footrest section 19 and the headrest section 15 (not shown in FIG. 5).

Also shown in FIG. 6, the bottom surface 26 includes the plurality of grippers 24. In one embodiment, the grippers 24 are placed along all sections of the bed 10.

Figure 7:
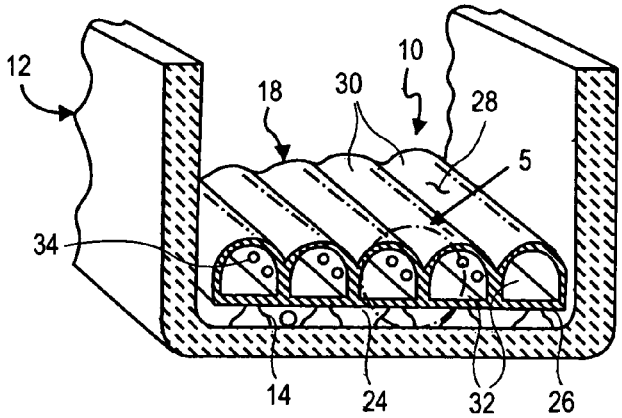
FIG. 7 is an enlarged diagrammatic perspective cross sectional view of the massaging fluid filled bed taken along line 4-4 in FIG. 4.

As shown in FIG. 7, the lowermost surface 26 of the bed 10 is substantially flat, and the uppermost surface of the bed 10 is formed into a plurality of members 30 that are inverted U-shaped and disposed side-by-side and extending longitudinally on the lowermost surface 28 of bed 10 so as to form therewith a plurality of tubes 32 that are inverted U-shaped and make up the body 18. The grippers 24 extend from the lowermost surface 26 of the bed 10. Although not visible in FIG. 7 (in order to not obscure the illustration), it is to be noted that the plurality of massaging elements 11 are disposed within the tubes 32 as shown in FIGS. 3A and 3B.

Figure 8:
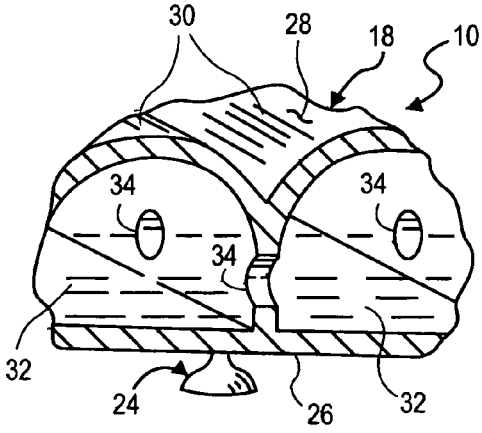
FIG. 8 is an enlarged diagrammatic perspective cross sectional view of the area generally enclosed by the dotted curve identified by arrow 5 in FIG. 7.

As shown in FIG. 8, the plurality of tubes 32 of the body 18 have a plurality of through bores 34 that extend through adjacent ones thereof so as to allow adjacent ones thereof to fluidly communicate with each other and isolate motion by displacing the water therein accordingly.

The specific configuration of the skid protectors 22 can best be seen in FIGS. 9 and 10, and as such, will be discussed with reference thereto.

Figure 9:
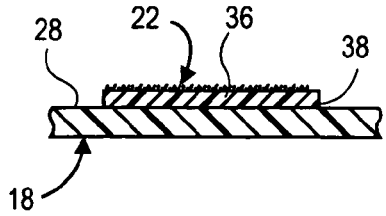
FIG. 9 is an enlarged diagrammatic cross sectional view taken along line 6*a*-6*a* in FIG. 5.
Figure 10:
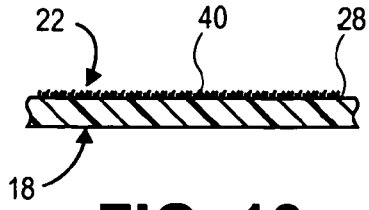
FIG. 10 is an enlarged diagrammatic cross sectional view taken along line 6*b*-6*b* in FIG. 5.

As shown in FIG. 9, strips of non-skid roughened material 36 are attached to the uppermost surface 28 of the body 18 by adhesive 38, or in the alternative, as shown in FIG. 10, strips of non-skid roughened material 40 are integrally formed with the uppermost surface 28 of the body 18.

Figure 11:
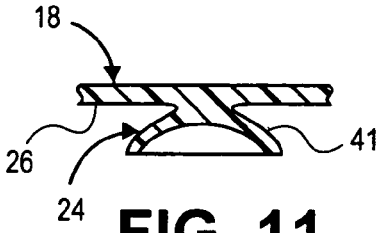
FIG. 11 is an enlarged diagrammatic cross sectional view taken along line 7-7 in FIG. 6.

The specific configuration of the grippers 24 can best be seen in FIG. 11, and as such, will be discussed with reference thereto.

The grippers 24 comprise a plurality of suction cups 41. The plurality of suction cups 41 of the grippers 24 depend from the lowermost surface 26 of the bed 10 and are for replaceably attaching to the bottom interior surface 14 of the bathtub 12. Each of the sections of the bed 10 should include a set of grippers 24 for attaching the respective sections to the interior surface 14 of the bathtub 12.

Figure 12:
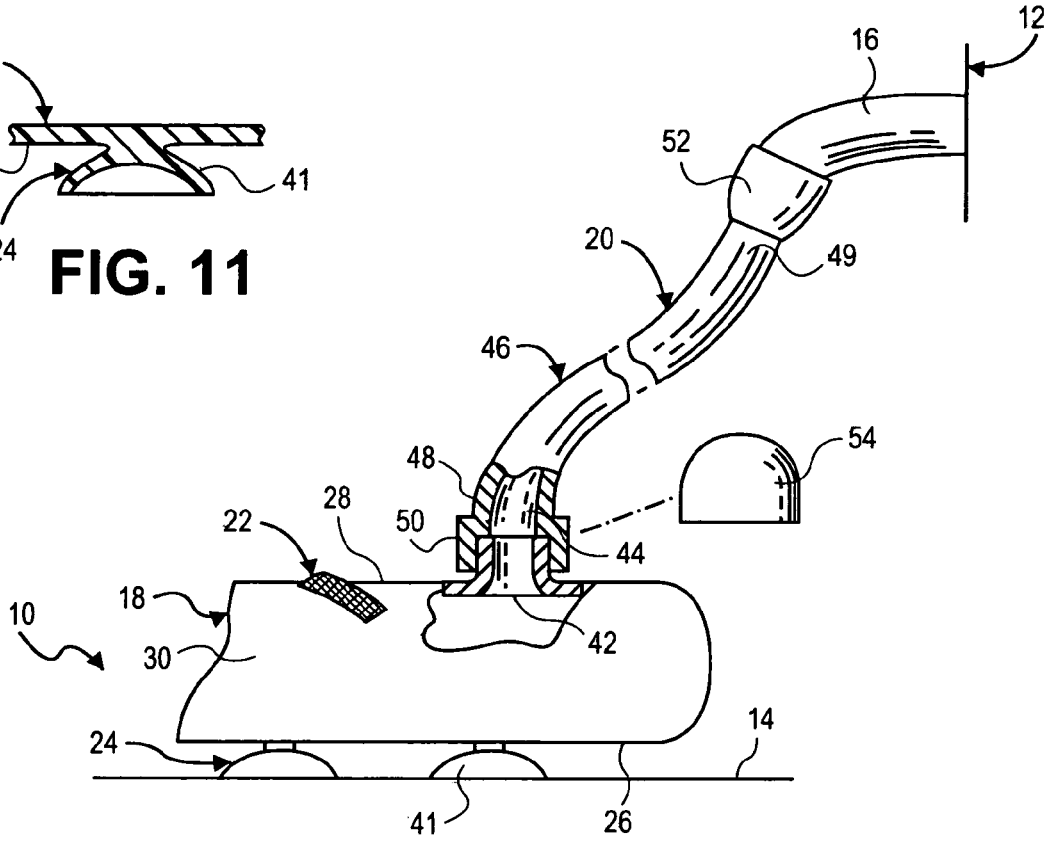
FIG. 12 is an enlarged diagrammatic side elevation view of the area generally enclosed by the dotted curve identified by arrow 8 in FIG. 6 with parts in section and broken away.

The specific configuration of the filler 20 can best be seen in FIG. 12, and as such, will be discussed with reference thereto.

The filler 20 comprises the uppermost surface of the body 18 having a through bore 42 formed with a neck 44 therearound.

The filler 20 further comprises a hose 46. The hose 46 has a first end 48 and a second end 49. In one embodiment, the first end 48 of the hose 46 of the filler 20 has a female connector 50 thereon that fluidly receives the neck 44 on the uppermost surface 28 of the bed 10 (e.g., at the footrest section 19). The second end 49 of the hose 46 of the filler 20 has a female connector 52 thereon for fluidly receiving the water faucet 16 (or other liquid or fluid dispenser device) of the bathtub 12 so as to allow the water from the water faucet to fill the body 18.

The filler 20 further comprises a cap 54. The cap 54 of the filler 20 closes the neck 44 of the body 18 once the body 18 has been filled with the water and the hose 46 of the filler 20 has been removed.

In one embodiment, the bed 10 also includes a drain plug or outlet 55 (FIG. 1) that allows water filled into the bathtub 12, and over the bed 10 to drain out. For instance, when the bed 10 is placed into the bathtub 12 and water is used to fill the bathtub 12, which has the bed 10 lined therein, the drain plug 55 is closed to keep the water within the tube and above the bed 10, and fills the bathtub 12. When ready, the plug 55 is opened to allow water drainage or replacement.

In alternative embodiments, the footrest section 19 of the bed 10 is divided into two sections 19A and 19B (FIG. 1) that extends upward to accommodate the user's feet portions. A cutout section 19C is provided between section 19A and 19B through which access to the drain of the bathtub 12 is provided. Thus, draining the water out of the bathtub 12 can be done as conventionally would.

It will be understood that each elements described above, or two or more together, may also find a useful application in other types of constructions differing from the types described above.

While the invention has been illustrated and described as embodied in a water bed for a bathtub, however, it is not limited to the details shown, since it will be understood that various omissions, modifications, substitutions and changes in the forms and details of the device illustrated and its operation can be made by those skilled in the art without departing in any way from the spirit of the present invention.

We claim:

1. A massaging fluid filled bed comprising:

a bed having a top surface, a bottom surface, a compartment disposed between said top surface and said bottom surface, plurality of grippers disposed on said bottom surface, a plurality of massaging elements disposed beneath said top surface, wherein said bed further is divided into a headrest section, a backrest section, a body section, and a footrest section;

an insulation layer affixed to said bottom surface;

a filler fluidly communicates to said headrest section, backrest section, body section, and footrest section to fill said bed with a fluid;

wherein each of said headrest section, backrest section, body section, and footrest section include several of said massaging elements;

wherein said plurality of massaging elements are attached to a base within said bed in a way that provide movement to said plurality of elements; and wherein at least said respective top surface of said body section, and backrest section comprise a plurality of inverted U-shaped members.

2. The massaging fluid filled bed of claim 1 further comprising:

a base layer disposed within said compartment of said bed wherein said plurality of massaging elements are attached thereto.

3. The massaging fluid filled bed of claim 1 further comprising:

a skid protector disposed on said top surface of said bed wherein each of said headrest section, backrest section, body section, and footrest section include a portion of said skid protector.

4. The massaging fluid filled bed of claim 1 wherein said massaging elements within said body section and said footrest section are made of harder material compared to said massaging elements within said headrest section and said backrest section.

5. The massaging fluid filled bed of claim 1 wherein said massaging elements have vary degrees of softness and hardness.

6. The massaging fluid filled bed of claim 1 wherein said bed is made of plastic.

7. The massaging fluid filled bed of claim 1 wherein said bottom surface is substantially flat with said plurality of said grippers extending therefrom.

8. The massaging fluid filled bed of claim 1 wherein said plurality of inverted U-shaped members are formed by said top surface of said bed extending longitudinally to said bottom surface of said bed so as to form therewith a plurality of tubes.

9. The massaging fluid filled bed of claim 8 wherein each of plurality of tubes comprising a through bore for said liquid to be filled therethrough.

10. The massaging fluid filled bed of claim 1 further comprising:

a drain plug disposed at an end of said bed.

11. The massaging fluid filled bed of claim 1 wherein said footrest comprises a first section and a second section and at cutout provided between said first section and said section.

12. The massaging fluid filled bed of claim 1 wherein a first fold is provided between said headrest section and said backrest section, a second fold is provided between said backrest section and said body section, and a third fold is provided between said body section and said footrest section.

13. The massaging fluid filled bed of claim 1 wherein a liquid is used to fill said bed.

14. The massaging fluid filled bed of claim 13 wherein said liquid is one of a hot liquid and a cold liquid.

15. A massaging fluid filled bed comprising:

a multi-layered bed having a top surface, a bottom surface, a middle support layer;

a fluid compartment disposed between said bottom surface and said middle based layer, plurality of grippers removably attached to and extend from said bottom surface;

a plurality of massaging elements moveably attached to said middle support layer and disposed beneath said top surface; and an insulation layer affixed to said bottom surface to prevent a temperature transfer across said bottom surface;

wherein said bed further is divided into a headrest section, a backrest section, a body section, and a footrest section;

a filler fluidly communicates to said headrest section, backrest section, body section, and footrest section to fill said bed with a liquid;

wherein each of said headrest section, backrest section, body section, and footrest section include some of said plurality of massaging elements, and wherein at least said respective top surface of said body section, and backrest section comprise a plurality of inverted U-shaped members.

16. The massaging fluid filled bed of claim 15 further comprising:

a skid protector disposed on said top surface of said bed wherein each of said headrest section, backrest section, body section, and footrest section include a portion of said skid protector.

17. The massaging fluid filled bed of claim 15 further comprising:

a plurality of skid protector strips disposed on said top surface of said bed wherein each of said headrest section, backrest section, body section, and footrest section include several of said skid protector strips.

18. The massaging fluid filled bed of claim 15 wherein said massaging elements have vary degrees of softness and hardness.

19. The massaging fluid filled bed of claim 15 wherein a liquid fills said fluid compartment.

20. The massaging fluid filled bed of claim 19 wherein said liquid provides one of a heat treatment and a cold treatment to a user laying on said top surface of said bed while said bed is placed within a bathtub.

* * * * *